US006391382B2

(12) United States Patent
Yamashita

(10) Patent No.: US 6,391,382 B2
(45) Date of Patent: May 21, 2002

(54) MANUFACTURING METHOD OF MAGNET RESIN COMPOUND

(75) Inventor: Fumitoshi Yamashita, Ikoma (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/217,832

(22) Filed: Dec. 22, 1998

(30) Foreign Application Priority Data

Dec. 26, 1997 (JP) ..... 9-359591

(51) Int. Cl.[7] ..... B05D 5/12; B05D 7/00

(52) U.S. Cl. ..... 427/212; 427/127; 427/216; 427/221

(58) Field of Search ..... 427/127, 212, 427/215, 216, 220, 221

(56) References Cited

U.S. PATENT DOCUMENTS 4,074,012 A * 2/1978 Heikinnen et al. ..... 427/127
4,368,237 A * 1/1983 Yamada et al. ..... 427/128
4,415,630 A * 11/1983 Kubota et al. ..... 427/127
5,096,741 A * 3/1992 Kobayashi et al. ..... 427/127
5,447,275 A * 9/1995 Goka et al. ..... 241/5

* cited by examiner

*Primary Examiner*—Brian K. Talbot
(74) *Attorney, Agent, or Firm*—Parkhurst & Wendel, L.L.P

(57) ABSTRACT

Fine powder out of adequate particle size range discharged in a manufacturing process of resin magnet compound comprising step 1 of mixing magnet powder such as neodymium-iron-boron system quenched alloy and an organic solvent solution of a thermal polymerizing resin in wet process, and step 2 of solvent removal-pulverizing-sorting into adequate particle size range is processed again in step 1 and step 2, and resin magnet compound within adequate particle size range is obtained again, and moreover the green matter obtained by strong compression of the resin magnet compound into a desired magnet shape is processed again at step 2 to obtain fine powder, which is processed again at step 1 and step 2, so that resin magnet compound within adequate particle size is obtained again.

13 Claims, 2 Drawing Sheets

MANUFACTURING METHOD OF MAGNET RESIN COMPOUND

FIELD OF THE INVENTION

The present invention relates to a manufacturing method of magnetic resin compound, and more particularly to a manufacturing method of magnetic resin compound capable of regenerating magnetic resin compound, green material and others out of the standard occurring in the manufacturing stage a of neodymium-iron-boron system quenched resin magnet.

BACKGROUND OF THE INVENTION

Prior arts relating to a compound of rare earth magnet powder and resin include Japanese Laid-open Patent No. 59-136907. This prior art presents:

1. A manufacturing method of samarium-cobalt system magnet using a thermoplastic resin by injection molding method, in which by using $R_2TM_{17}$ (where R is a rare earth element such as samarium and TM is a transition metal, or mainly cobalt) as samarium-cobalt system magnet powder, as compared with the case of using $RCo_5$, the injection-molded magnet, or the compound of rare earth magnet powder such as sprue or runner and resin composition can be more easily ground to be presented again for injection molding.
2. It is easier to handle by demagnetizing the injection-molded magnet or sprue or runner of the molded piece.
3. When the material regenerated from the injection-molded magnet or the sprue or runner of the molded piece is mixed with a kneaded material, there is suppressed lowering of magnetic performance or mechanical properties. It is hence an object thereof to manufacture the samarium-cobalt system resin magnet efficiently in an industrial scale by injection molding.

It is, however, known well that the samarium-cobalt system magnet powder is inferior in resource balance because samarium and cobalt are much contained.

In the case of the magnet being manufactured by injection molding, the sprue and runner occupy 80 to 90% of the entire molded piece of the magnet in a small magnet weighing not more than several grams, such as the one used in the driving source of peripheral device for multimedia PC (personal computer) or the like, and the materials such as samarium-cobalt system magnet powder and thermoplastic resin are spent wastefully in the non-usable parts such as sprue and runner rather than the magnet main body, and energy and materials for injection molding are consumed, which is not preferable from the viewpoint of saving energy and saving resources. Moreover, for injecting the kneaded plastic fused strands to fill in the molding die cavity, the mixing rate of the samarium-cobalt system magnet powder must be 65 vol. % or less. However, keeping the mixing rate of the magnet powder at 65% or less is not advantageous from the standpoint of seeking the magnetic performance for making the best of the magnetic potential of the rare earth magnet.

To increase the volume percentage of the samarium-cobalt system magnet powder and make the best of the magnetic potential of the rare earth magnet powder, it is advantageous to compress the rare earth magnet powder strongly together with thermal polymerizing resin such as epoxy resin because the sprue and runner are not required and the magnetic performance is enhanced.

In the prior art, however, nothing has been known about a technique for compressing the rare earth magnet powder including samarium-cobalt system magnet powder strongly in a specified magnet shape together with thermal polymerizing resin such as epoxy resin.

On the other hand, because there is at present mass use of rare earth resin magnet in the driving source of peripheral device of multimedia PC or the like, it is desired to save resources by using neodymium-iron-boron system quenched magnet powder having an alloy composition excellent in resource balance as compared with the samarium-cobalt system magnet powder, and reduce the disposal amount of magnet materials by reusing the magnetic resin compound of rare earth magnet powder and thermal polymerizing resin.

The invention therefore relates to the neodymium-iron-boron system quenched resin magnet excellent in resource balance of alloy composition as compared with the samarium-cobalt system magnet powder, and used in quantities in the driving source of peripheral device of multimedia PC or the like, and more particularly to a manufacturing method of green matter formed by strongly compressing neodymium-iron-boron system quenched magnet powder resin compound, and a manufacturing method for reusing the magnetic resin compound composed of neodymium-iron-boron system quenched magnet powder and thermal polymerizing resin, so that the disposal amount of the precious magnet material can be reduced.

SUMMARY OF THE INVENTION

The invention provides a manufacturing method of magnetic resin compound comprising step 1 of mixing magnet powder and an organic solvent solution of a thermal polymerizing resin in wet process, and step 2 of solvent removal-pulverizing-sorting into adequate particle size range, in which fine powder out of adequate particle size range discharged at step 2 is granulated within the adequate particle size range after the wet process mixing of step 1 and solvent removal-pulverizing-sorting of step 2, so that the disposal amount of magnet material may be reduced.

DESCRIPTION OF THE PREFERRED EMBODIMENTS

Figure 1:
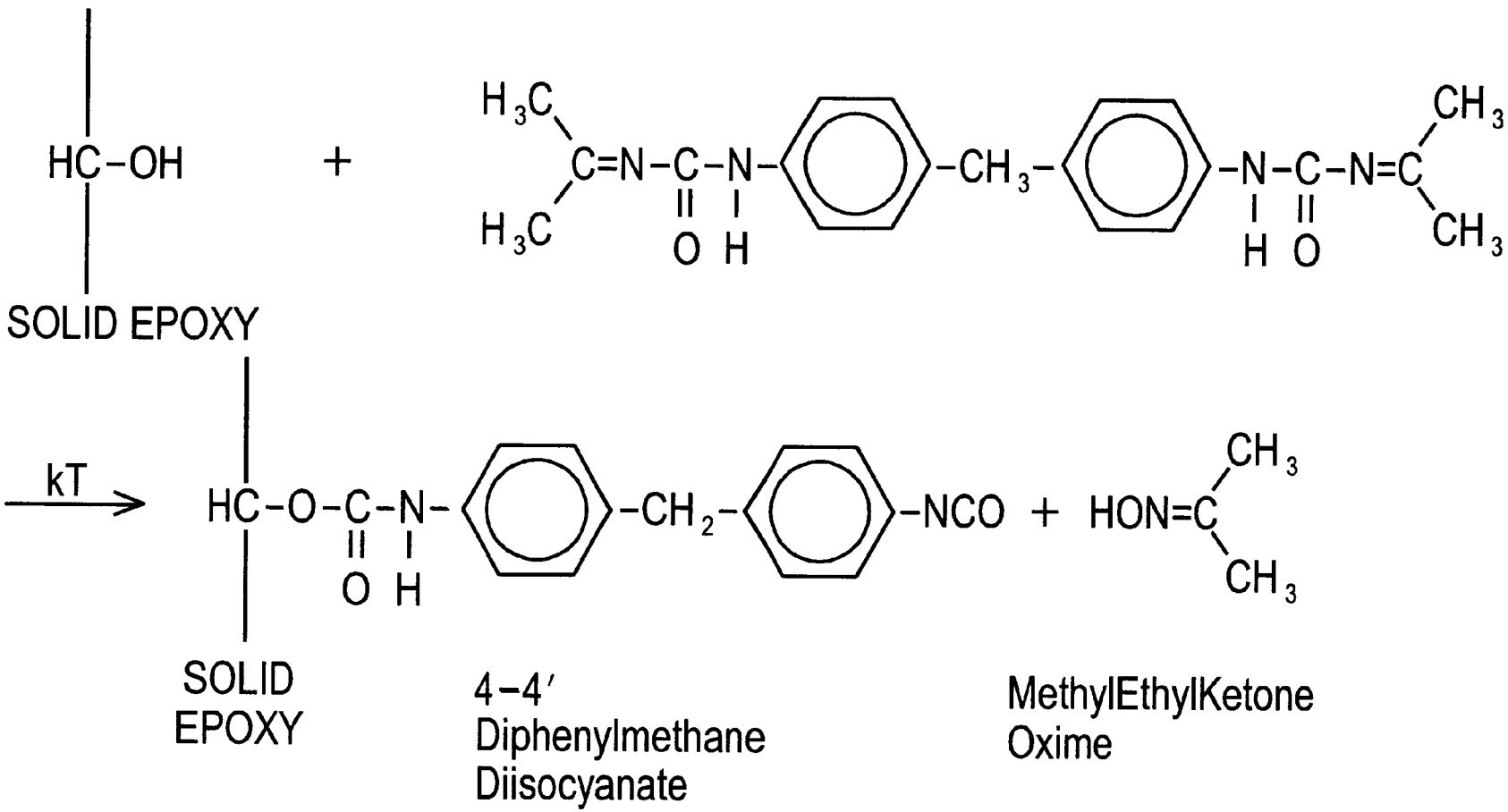
FIG. 1 is a chemical reaction formula of thermal polymerizing reaction of epoxy oligomer and to blocked isocyanate.

As an embodiment of the invention, an example of using neodymium-iron-boron system quenched magnet powder as magnet powder is described below.

The embodiment relates to a manufacturing method of magnetic resin compound comprising step 1 of mixing neodymium-iron-boron system quenched magnet powder and an organic solvent solution of a thermal polymerizing resin in wet process, and step 2 of solvent removal-pulverizing-sorting into adequate particle size range, in which fine powder out of adequate particle size range discharged at step 2 is processed again by wet process mixing of step 1 and solvent removal-pulverizing-sorting of step 2 to regenerate granular magnetic resin compound within adequate particle size range, so that the fine powder out of adequate particle size range can be reused.

Moreover, a granular magnetic resin compound is strongly compressed into a desired magnet shape to form a green compact, and this green compact is pulverized and sorted to obtain fine powder, and it is processed again by wet process mixing of step 1 and solvent removal-pulverizing-sorting of step 2, and a granular magnetic resin compound within adequate particle size range is obtained once more, so that the green compact formed in an inappropriate shape may be regenerated and used.

The following measures are effective so as not to spoil the performance and quality of neodymium-iron-boron system quenched resin magnet.

1. The amount of fine powder to be added is 25 parts or less by weight to 100 parts by weight in total of neodymium-iron-boron system quenched magnet powder and thermal polymerizing resin to be mixed by wet process.
2. More than 50 wt. % of this fine powder is 38 $\mu$m or more in particle size.
3. The thermal polymerizing resin is mainly composed of at least one kind of polymer having a functional group capable of reacting with an isocyanate group in its molecular chain, and isocyanate regenerated material.
4. As the polymer having a functional group capable of reacting with an isocyanate group in its molecular chain, diglycidyl ether bisphenol A with a melting point of 90±5° C. is used.
5. The blocked isocyanate has a structure of blocking the isocyanate group of 4-4'-diphenyl methane diisocyanate by methyl ethyl ketone oxime.

(Embodiments)

Recently, neodymium-iron-boron system quenched resin magnets of a relatively small shape are massively used as key members of motors and actuators such as a spindle motor and a stepping motor widely used as driving sources of multimedia PC peripheral devices. The invention relates to such neodymium-iron-boron system quenched resin magnets, and more particularly to regeneration of magnetic resin compound of neodymium-iron-boron system quenched magnet powder such as granular resin compound and green compact in the magnet manufacturing state, and a thermal polymerizing resin.

Incidentally, the thermal polymerizing resin such as epoxy resin is slightly progressed in the polymerizing reaction even at room temperature. As a result, it is gradually thickened and is finally gelated. A gelated epoxy resin cannot be formed into neodymium iron-boron system quenched magnet powder. Therefore, the thermal polymerizing resin for forming the neodymium-iron-boron system quenched magnet powder is desired not to polymerize at room temperature, and to be cured quickly in thermal polymerization.

The thermal polymerizing resin in the invention is mainly composed of at least one kind of polymer having a functional group capable of reacting with an isocyanate group in its molecular chain, and blocked isocyanate. Herein, the functional group capable of reacting with an isocyanate group includes, among others, —OH, —COOH, —NHCO—, —NHCOO—, —NHCONH, —SH, —CHS, —CSOH, and active methylene. Any polymer having any one of these functional groups may be used, and more preferably the polymer is desired to have —OH, — NHCO—, —NHCOO—, or —NHCONH in the molecular chain. Examples of polymer having -alcoholic-OH group in the molecular chain include epoxy, phenol, urethane, urea and other oligomers, polyether, polyether ester, polyester imide, and other polymers, and more preferably it should be a diglycidyl ether bisphenol A type epoxy oligomer with a thermal softening temperature of 90±5° C., expressed in the following formula, obtained by reaction condensation of epichlorohydrin and bisphenol A. Herein, the thermal softening temperature is defined at 90±5° C. because, if the softening temperature is lower, the apparent density and flowability of the neodymium-iron-boron system quenched magnet powder-resin compound are changed in the room temperature region below 45° C., or if the softening temperature is higher, it is hard to obtain a green compact of high density.

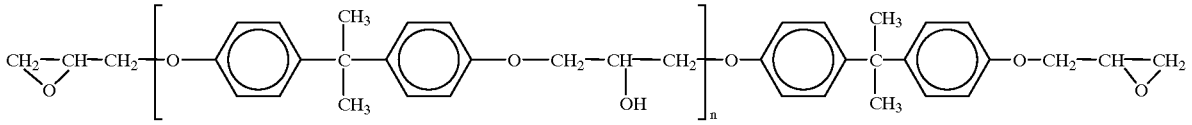

The neodymium-iron-boron system quenched magnet powder in the invention is manufactured, for example as disclosed in J. F. Herbest, "Rare Earth-Iron-Boron Materials: A New Era in Permanent Magnets," Ann. Rev. Sci., Vol. 16 (1986), by quenching and solidifying a molten alloy containing Nd:Fe:B nearly at a rate of 2:14:1, and heating properly to crystallize in a phase of $Nd_2Fe_{14}B$ in crystal particle size of 20 to 100 nm. Generally, the residual magnetizing Jr is 8 kG and the intrinsic coercive force Hcj is 8 kOe or more. However, since the quenched and solidified alloy of neodymium-iron-boron system is a so-called flake powder of 20 to 30 $\mu$m in thickness, this powder must be formed into a desired magnet shape by some method or other in order to used as a general magnet. The means of forming the neodymium-iron-boron system quenched magnet powder into a desired shape is generally means of kneading together with thermal polymerizing resin such as epoxy resin, compressing strongly to form into a green compact, and thermally polymerizing this formed material into a resin magnet.

In the formula, —$C(CH_3)_2$— of bisphenol A may be replaced also by —O—, —S—, —SO—, —$SO_2$—, —$CH_2$—, —$(CH_2)_2$—, or the like.

The blocked isocyanate is an organic compound obtained by stabilizing polyisocyanate having an isocyanate group by a compound having an alcoholic —OH group in its molecule. Herein, examples of polyisocyanate include 2-4 tolylene diisocyanate, 2-6 tolylene diisocyanate, cyclopentylene diisocyanate, m-phenylene diisocyanate, p-phenylene diisocyanate, ethylene diisocyanate, butylidene diisocyanate, 1-5 naphthalene diisocyanate, 1-6 hexamethylene diisocyanate, 4-4' diphenyl methane diisocyanate, 4-4' diphenyl ether diisocyanate, xylene diisocyanate, or other diisocyanates, and diisocyanate compounds of valence of 3 or more, for example, cyclic trimer of 2-4 tolylene diisocyanate, cyclic trimer of 2-6 tolylene diisocyanate, and trimer of 4-4' diphenyl methane diisocyanate.

The compound for stabilizing the isocyanate group of these organic compounds may be, for example, aliphatic alcohols such as methyl alcohol, ethyl alcohol, n-propyl alcohol, iso-propyl alcohol, and n-butyl alcohol, alicyclic alcohols such as cyclohexyl alcohol and 2-methyl hexyl alcohol, monovalent alcohols such as benzyl alcohol, phenyl cellosolve, and furfuryl alcohol, and polyhydric alcohol derivatives such as ethylene glycol monoethyl ether, ethylene glycol isopropyl ether, and ethylene glycol monobutyl ether. Aside from these alcohols, examples of the compound for stabilizing the isocyanate group include phenol, cresol, xylenol, p-ethol phenol, o-isopropyl phenol, p-t butyl phenol, p-t octyl phenol, p-catechol, resorcinol, other phenols, and also other active methylene compounds such as dimethyl malonate, diethyl malonate, acetoacetic methyl, acetoacetic ethyl, and methyl ethyl ketone oxime.

FIG. 1 shows a thermal polymerizing reaction formula of the epoxy oligomer and blocked isocyanate.

In the thermal polymerizing reaction of the thermal polymerizing resin of epoxy oligomer and 4-4' diphenyl methane diisocyanate blocked by methyl ethyl ketone oxime, first, the methyl ethyl ketone oxime of the isocyanate regenerated material is thermally dissociated (140° C. or higher), and the isocyanate group of the liberated 4-4' diphenyl methane diisocyanate is quickly polymerized with the alcoholic OH group in the molecular chain of the epoxy oligomer to form an insoluble and infusible three-dimensional network structure, so that the neodymium-iron-boron system quenched magnet powder is firmly fixed.

On the other hand, the neodymium-iron-boron system quenched magnet powder does not promote dissociation of methyl ethyl ketone oxime. Therefore, the neodymium-iron-boron system quenched magnet powder-resin compound of the invention is not changed in the molecular weight of the resin component and is not gelated if let stand in room temperature region for more than 5 years.

The invention relates to a manufacturing method of a granular magnetic resin compound composed of 2–3 wt. % of thermal polymerizing resin of epoxy oligomer and 4-4' diphenyl methane diisocyanate blocked by methyl ethyl ketone oxime which is hardly polymerized in room temperature region as mentioned above, and 97–98 wt. % of neodymium-iron-boron system quenched magnet powder with a specific surface area of 0.05 $m^2/g$ and a true density of 7.55 $g/cm^3$, and a green compact obtained by compressing it strongly.

Figure 2:
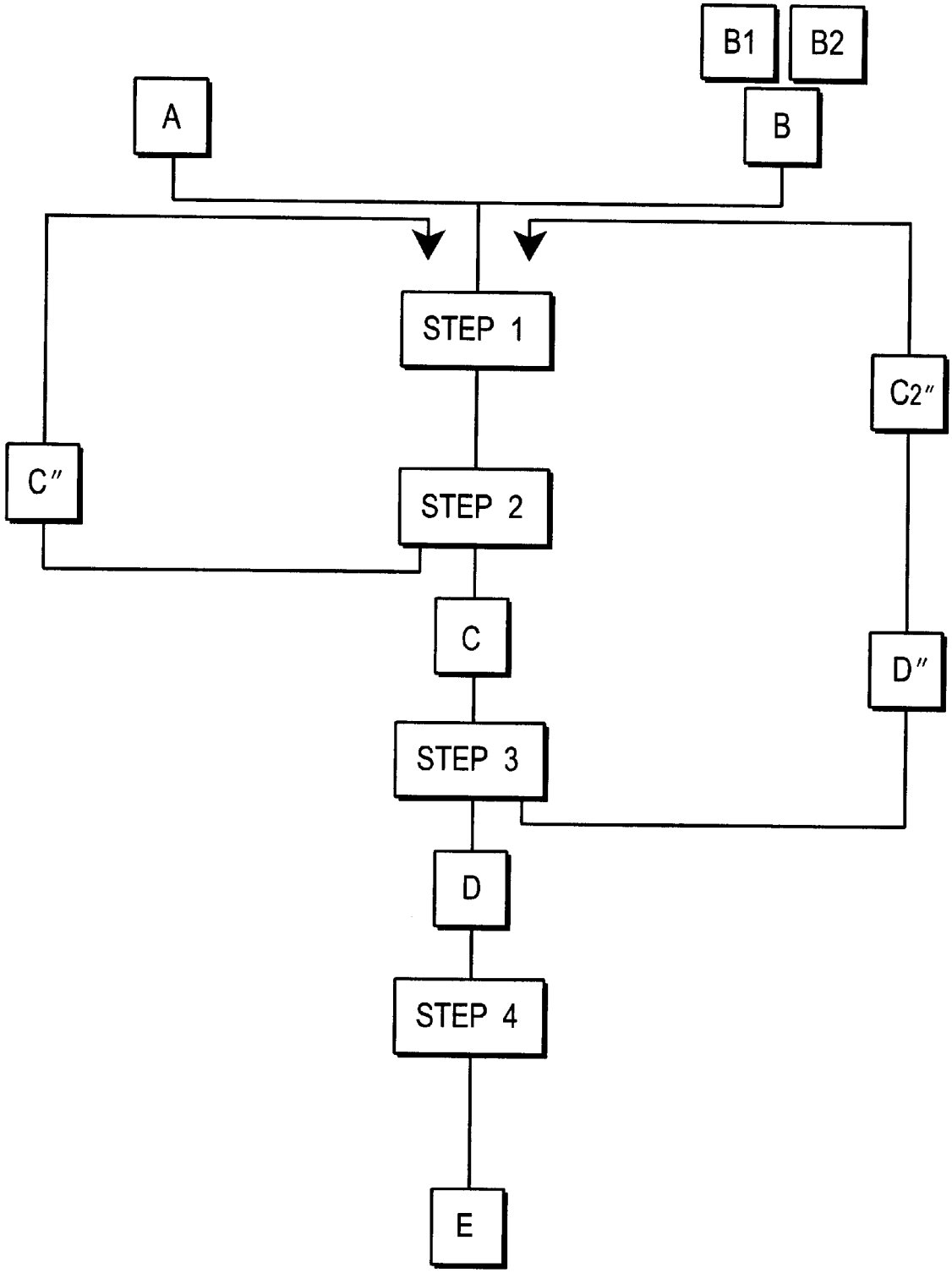
FIG. 2 is a block diagram showing a regenerating process of neodymium-iron-boron system quenched magnet powder resin compound.

FIG. 2 is a process diagram showing the manufacturing method in an embodiment of the invention. In FIG. 2, reference symbol A denotes neodymium-iron-boron system quenched magnet powder, and B1 is a polymer having a functional group capable of reacting with an isocyanate group in its molecular chain, for example, diglycidyl ether bisphenol A type epoxy oligomer with a thermal softening temperature of 90±5° C. Reference symbol B2 denotes a blocked isocyanate, for example, a blocked isocyanate regenerated matter having the isocyanate group of 4-4' diphenyl methane diisocyanate blocked by methyl ethyl ketone oxime. Reference symbol B denotes an organic solvent solution of thermal polymerizing resin containing the oligomer B1 and blocked isocyanate B2. Herein, the organic solvent is a general solvent such as acetone, methyl ethyl ketone, or methyl isobutyl ketone.

Further, step 1 is a wet process mixing step of magnet powder A and thermal polymerizing resin solution B, and step 2 is a step of solvent removal-pulverizing-sorting the mixture obtained at step 1 into adequate particle size range, and forming a granular resin magnet compound C. Next step 3 is a step of compressing the granular resin magnet compound within the adequate particle size range strongly into a specified magnet shape to form a green compact D. Step 4 is a step of curing the thermal polymerizing resin to obtain a neodymium-iron-boron system quenched resin magnet E.

The granular magnetic resin compound C obtained at step 2 is strongly compressed into a specified magnet shape at step 3 to obtain the green compact D. At this time, in order to assure the density and dimensional precision of the green compact, for example as disclosed in Japanese Laid-open Patent No. 63-194312, more than 50 wt. % of the granular magnetic resin compound C is required to be 75 $\mu$m or more in particle size. However, those particles exceeding the adequate particle size range can be directly pulverized and sorted again at step 2, but generation of fine powder C" below particle size of 75 $\mu$m, especially below particle size of 53 $\mu$m cannot be prevented.

Further, when obtaining the green compact D by strongly compressing the granular magnetic resin compound C within the adequate particle size range into a specified magnet shape at step 3, generation of green compact D" not satisfying the necessary conditions as the neodymium-iron-boron system quenched resin magnet E cannot be prevented due to changes of magnet shape, adjustment of compression condition, apparatus operating condition or other problems.

The invention is intended to transform the fine powder C" into the granular magnetic resin compound C within the adequate particle size range again after step 1 of wet process mixing and step 2 of solvent removal-pulverizing-sorting, and more particularly the green compact D out of the standard generated by strong compression of the compound C into a desired magnet shape is pulverized and sorted the same way as at step 2 to produce fine powder C2", and is formed into granular magnetic resin compound in the adequate particle size range again through step 1 of wet process mixing and step 2 of solvent removal-pulverizing-sorting.

Moreover, so as not to spoil the performance and quality of the neodymium-iron-boron system quenched resin magnet, fine powder C" or fine powder C2 by pulverizing the green compact D" is added by 25 parts by weight or less to 100 parts by weight of the sum of the neodymium-iron-boron system quenched magnet powder and thermal polymerizing resin to be mixed by wet process. The reason is to suppress lowering of powder molding performance (flowability, apparent density) of the regenerated granular magnetic resin compound C and density or mechanical strength of the obtained green compact D. Besides, more than 50 wt. % of the fine powder C" or C2" must be 38 $\mu$m or more in the particle size.

This is because if the fine powder having the particle size of 38 $\mu$m or less is present by more than 50 wt. %, a step is caused in the 4π I-H curve of the magnet, which may lead to lowering of magnetic flux amount at the operation point or lowering of demagnetization resistance to inverse magnetic field.

The manufacturing method of the invention including the regeneration step of magnetic resin compound is further described below while referring to FIG. 2.

In FIG. 2, reference symbol A is neodymium-iron-boron system quenched magnet powder of alloy composition $Nd_{12}Fe(balance)Co_5B_6$ occupying 97.5 wt. % in material mixture 100 of magnetic resin compound, and B is an acetone solution containing 2.5 wt. % of epoxy resin composed of diglycidyl ether bisphenol A type epoxy oligomer (B1) with a thermal softening temperature of 90±5° C. and blocked isocyanate (B2) having the isocyanate group of 4-4' diphenyl methane diisocyanate blocked by methyl ethyl ketone oxime.

Step 1 is a wet process mixing step of magnet powder A and resin solution B in a batch of 10 kg, and step 2 is a step of solvent removal-pulverizing-sorting the mixture obtained at step 1 into adequate particle size range (53 to 250 μm) to obtain granular magnetic resin compound C. Next step 3 is a step of compressing strongly the granular magnetic resin compound C within the adequate particle size range into a specified magnet shape to obtain green compact D. Step 4 is a step of forming neodymium-iron-boron system quenched resin magnet E by curing the thermal polymerizing resin.

In the granular magnetic resin compound C obtained at step 2, fine powder C" of 53 μm or less in particle size is mixed and discharged by about 2%. Further at step 3, material out of standard of the neodymium-iron-boron system quenched resin magnet E is discharged by about 0.1%.

In the invention, the fine powder C" of 53 μm or less in particle size is processed again at step 1 of wet process mixing and step 2 of solvent removal-pulverizing-sorting, and granular magnetic resin compound C within adequate particle size range is obtained. The green compact D out of the standard generated by strong compression of the magnetic resin compound C into a desired magnet shape is pulverized and sorted the same way as at step 2, and fine powder C2" of 150 μm or less in particle size is obtained, and it is repeatedly processed at step 1 of wet process mixing and step 2 of solvent removal-pulverizing-sorting, and granular magnetic resin compound C within adequate particle size range is obtained again.

Table 1 is a characteristic table showing the results of measurement of flowability (JIS Z 2502) and apparent density (JIS Z 2504) of the granular magnetic resin compound C obtained by varying the mixing rate of the fine powder C" when granular magnetic resin compound C within adequate particle size range is obtained again by processing the fine powder C" of 53 μm or less in particle size by step 1 of wet process mixing and step 2 of solvent removal-pulverizing-sorting, and pressure ring strength, density (Archimedean method), and magnetic characteristics (after 50 kOe pulse magnetization: measured magnetic field ±25 kOe: VSM) of the resin magnet E by thermal polymerization of green compact D obtained by strong compression at 8 tons/cm$^2$ at 160° C. for 5 minutes.

TABLE 1

| Fine powder C" | Prior art | Invention | | | | Comparative example |
|---|---|---|---|---|---|---|
| content, wt. % | 0 | 10 | 15 | 20 | 25 | 30 |
| Flowability s/50 g | 42.1 | 42.22 | 43.4 | 42.5 | 42.6 | 48.9 |
| Apparent density g/cm$^3$ | 2.72 | 2.70 | 2.75 | 2.74 | 2.78 | 3.01 |
| Pressure ring strength kgf/mm$^2$ | 4.60 | 4.53 | 4.55 | 4.51 | 4.41 | 3.82 |
| Resin magnet density g/cm$^3$ | 5.99 | 6.01 | 6.01 | 5.98 | 5.97 | 5.78 |
| Intrinsic coercive force $H_{CJ}$/kOe | 9.10 | 9.23 | 9.10 | 9.09 | 9.05 | 8.76 |
| Residual magnetization Br/kG | 7.11 | 7.07 | 7.00 | 6.97 | 6.93 | 6.43 |
| Maximum energy product MGOe | 9.87 | 9.88 | 9.79 | 9.55 | 9.47 | 8.25 |

As clear from Table 1, the invention can manufacture the neodymium-iron-boron system quenched magnet powder-resin compound maintaining the same molding performance as in the prior art without containing fine powder C" and neodymium-iron-boron system quenched resin magnet having the same magnetic characteristic and mechanical strength as shown for the prior art.

Table 2 is a characteristic table showing the results of measurement of flowability (JIS Z 2502) and apparent density (JIS Z 2504) of the granular magnetic resin compound C obtained by varying the mixing rate of the fine powder C2" when granular magnetic resin compound C within adequate particle size range is obtained again by processing the green compact D" out of the standard generated by strong compression of the compound C into a desired magnet shape by pulverizing and sorting same as at step 2 to obtain fine powder C2" of 150 μm or less in particle size and processing again at step 1 of wet process mixing and step 2 of solvent removal-pulverizing-sorting, and pressure ring strength, density (Archimedean method), and magnetic characteristics (after 50 kOe pulse magnetization: measured magnetic field ±25 kOe: VSM) of the resin magnet E by thermal polymerization of green compact D obtained by strong compression at 8 tons/cm$^2$ at 160° C. for 5 minutes.

TABLE 2

| Fine powder $C_2$" | Prior art | Invention | | | | Comparative example |
|---|---|---|---|---|---|---|
| content, wt. % | 0 | 10 | 15 | 20 | 25 | 30 |
| Flowability s/50 g | 41.9 | 42.6 | 43.5 | 44.2 | 45.1 | 52.8 |
| Apparent density g/cm$^3$ | 2.72 | 2.75 | 2.77 | 2.73 | 2.77 | 3.05 |
| Pressure ring strength kgf/mm$^2$ | 4.61 | 4.56 | 4.52 | 4.51 | 4.25 | 3.67 |
| Resin magnet density g/cm$^3$ | 5.99 | 6.00 | 6.02 | 6.00 | 6.01 | 5.83 |
| Intrinsic coercive force $H_{CJ}$/kOe | 9.10 | 9.05 | 9.12 | 9.11 | 9.06 | 8.60 |
| Residual magnetization Br/kG | 7.11 | 7.05 | 7.12 | 7.02 | 7.03 | 6.41 |
| Maximum energy product MGOe | 9.87 | 9.82 | 9.90 | 9.86 | 9.76 | 8.18 |

As clear from Table 2, the embodiment can manufacture the neodymium-iron-boron system quenched magnet powder-resin compound maintaining the same molding performance as in the prior art without containing fine powder C2" and neodymium-iron-boron system quenched resin magnet having the same magnetic characteristic and mechanical strength as shown in the prior art.

As evident from the embodiment, the invention can reduce the disposable amount of the product out of the standard generated when molding the magnetic resin compound and resin magnetic, and its industrial value is outstanding.

What is claimed is:

1. A method of manufacturing a granular magnetic resin compound for a resin-bonded permanent magnet comprising the steps of:

mixing a magnetic powder for the permanent magnet and an organic solvent solution of a thermal polymerizing resin including blocked isocyanate as a hardener in wet process, to obtain a first mixture;

removing solvent from the first mixture, pulverizing and sorting into a predetermined particle size range at a temperature not more than a thermal dissociation temperature of the blocked isocyanate;

mixing a fine powder out of the predetermined particle size range discharged at the solvent removal step, pulverizing and sorting the magnetic powder and the organic solvent solution in wet process to obtain a second mixture; and removing solvent from the second mixture, pulverizing and sorting into the predetermined particle size range at a temperature not more than a thermal dissociation temperature of the blocked isocyanate.

2. A method of manufacturing a granular magnetic resin compound for a resin-bonded permanent magnet comprising the steps of:

mixing a magnetic powder for the permanent magnet and an organic solvent solution of a thermal polymerizing resin including blocked isocyanate as a hardener in wet process, to obtain a first mixture;

removing solvent from the first mixture, pulverizing and sorting into a predetermined particle size range at a temperature not more than a thermal dissociation temperature of the blocked isocyanate, to obtain a granular compound within the predetermined particle size range;

forming a first green compact having a predetermined shape by compressing the granular compound;

pulverizing a second green compact out of the predetermined shape discharged at the forming step to obtain a fine powder; and mixing the fine powder, the magnetic powder and the organic solvent solution in wet process, to obtain a second mixture; and removing solvent from the second mixture, pulverizing and sorting into the predetermined particle size range at a temperature not more than a thermal dissociation temperature of the blocked isocyanate.

3. A method of manufacturing a granular magnetic resin compound according to claim 1, wherein an amount of the fine powder to be mixed is 25 parts or less by weight to 100 parts by weight in total of the magnetic powder and thermal polymerizing resin at the step of mixing to obtain the second mixture.

4. A method of manufacturing a granular magnetic resin compound according to claim 1, wherein 50 wt. % or more of the fine powder is 38 $\mu$m or more in particle size.

5. A method of manufacturing a granular magnetic resin compound according to claim 1, wherein the thermal polymerizing resin comprises at least one kind of polymer having a functional group capable of reacting with an isocyanate group in its molecular chain and blocked isocyanate.

6. A method of manufacturing a granular magnetic resin compound according to claim 5, wherein the polymer is diglycidyl ether bisphenol A with a melting point of 90±5° C.

7. A method of manufacturing a granular magnetic resin compound according to claim 5, wherein the blocked isocyanate has a structure of blocking the end isocyanate group of 4-4' diphenyl methane diisocyanate by methyl ethyl ketone oxime.

8. A method of manufacturing a granular magnetic compound according to claim 2, wherein an amount of the fine powder to be mixed is 25 parts or less by weight to 100 parts by weight in total of the magnetic powder and thermal polymerizing resin at the step of mixing to obtain the second mixture.

9. A method of manufacturing a granular magnetic resin compound according to claim 2, wherein at least 50 wt. % of the fine powder is at least 38 $\mu$m in particle size.

10. A method of manufacturing a granular magnetic resin compound according to claim 2, wherein the thermal polymerizing resin comprises at least one kind of polymer having a functional group capable of reacting with an isocyanate group in its molecular chain and blocked isocyanate.

11. A method of manufacturing a granular magnetic resin compound according to claim 10, wherein the polymer is diglycidyl ether bisphenol A with a melting point of 90±5° C.

12. A method of manufacturing a granular magnetic resin compound according to claim 11, wherein the blocked isocyanate has a structure of blocking the end isocyanate group of 4-4'-diphenyl methane diisocyanate by methyl ethyl ketone oxime.

13. A method of manufacturing a resin-bonded permanent magnet comprising a granular magnetic resin compound, the method comprising the steps of:

(a) mixing a magnetic powder for the permanent magnet and an organic solvent solution of a thermal polymerizing resin including blocked isocyanate as a hardener in wet process, to obtain a first mixture;

(b) removing solvent from the first mixture, pulverizing and sorting the remaining product into a predetermined particle size range at a temperature not more than a thermal dissociation temperature of the blocked isocyanate, to obtain a granular compound within the predetermined particle size range;

(c) forming a first green compact having a predetermined shape by compressing the granular compound formed in step (b);

(d) pulverizing a second green compact out of the predetermined shape outside the predetermined particle size range discharged at forming step (c) to obtain a fine powder;

(e) mixing the fine powder, the magnetic powder and the organic solvent solution in wet process, to obtain a second mixture;

(f) removing solvent from the second mixture, pulverizing and sorting the remaining product into the predetermined particle size range at a temperature not more than a thermal dissociation temperature of the blocked isocyanate;

(g) adding the particles obtained in steps (b) and (f) in mixing step (a); and (h) curing the first green compact of step (c).

* * * * *